US006969019B2

(12) United States Patent
Aikawa

(10) Patent No.: US 6,969,019 B2
(45) Date of Patent: Nov. 29, 2005

(54) REFINER AND AGITATING APPARATUS FOR PAPERMAKING

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 588 days.

(21) Appl. No.: 10/080,570

(22) Filed: Feb. 25, 2002

(65) Prior Publication Data

US 2003/0071153 A1 Apr. 17, 2003

(30) Foreign Application Priority Data

Oct. 16, 2001 (JP) ..... 2001-317843

(51) Int. Cl.[7] ..... B02C 7/12
(52) U.S. Cl. ..... 241/261.1; 241/261.2
(58) Field of Search ..... 241/261.1, 261.2, 241/261.3, 296, 298, 247

(56) References Cited

U.S. PATENT DOCUMENTS 5,042,726 A * 8/1991 Reinhall ..... 241/28
5,200,038 A 4/1993 Brown

FOREIGN PATENT DOCUMENTS

| | | |
|---|---|---|
| EP | 1 070 543 | 1/2001 |
| GB | 737051 | 9/1955 |
| GB | 2 083 375 | 3/1982 |

* cited by examiner

*Primary Examiner*—Mark Rosenbaum
(74) *Attorney, Agent, or Firm*—Manabu Kanesaka

(57) ABSTRACT

A refiner for separating and beating a material includes a conical type stationary shell including a first beating section; a ring-shaped stationary disc provided on an outer edge of the conical type stationary shell and including a second beating section; a rotational shaft; a conical type rotor attached to and supported by the rotational shaft including a third beating section facing the first beating section to create a gap between the first beating section and the third beating section for the material to pass through; and a ring-shaped rotor disc provided on an outer edge of the conical type rotor and including a fourth beating section facing the second beating section to create a gap between the second beating section and the fourth beating section for the material to pass through.

8 Claims, 8 Drawing Sheets

REFINER AND AGITATING APPARATUS FOR PAPERMAKING

BACKGROUND OF THE INVENTION AND RELATED ART STATEMENT

The present invention relates to a refiner and an agitating apparatus for papermaking, and especially, it relates to a refiner and an agitating apparatus for papermaking, which are provided with both a conical type and a disc type.

A refiner is used for separating and beating or dissociating a raw material by allowing the raw material to pass through a gap or space between a rotor and a stator, and there are a conical type refiner in which a portion with a blade is a conical shape, and a disc type refiner in which a portion with a blade is a disc shape.

As compared with the disc type refiner, a residence or operation time of the raw material in the conical type refiner tends to be longer. Also, the blade of the conical type refiner has a complicated shape, so machining thereof is difficult. Thus, in many cases, the blade is used as cast, and a dimensional accuracy of a clearance or gap between the rotor and the stator is not so good.

On the other hand, the disc type refiner is easy to be machined as compared with the conical type refiner, and a dimensional accuracy of the gap between the rotor and the stator is good. These types have both advantages and disadvantages, respectively, and there have been no refiners having both the conical type and the disc type.

The present invention has been made in view of the foregoing, and an object of the invention is to provide a refiner with advantages of both the conical type and the disc type.

Further objects and advantages of the invention will be apparent from the following description of the invention.

SUMMARY OF THE INVENTION

To achieve the above object, a first aspect of the present invention provides a refiner, comprising: a conical type stationary shell including a beating section; a stationary ring-shaped disc provided on an outer edge of the conical type stationary shell and including a beating section; a conical type rotor attached to a rotational shaft and including a beating section on a surface facing the conical type stationary shell; and a ring-shaped rotor disc provided on an outer edge of the conical type rotor and including a beating section on a surface facing the conical type stationary shell. The beating section of the conical type rotor is opposed to that of the conical type stationary shell to thereby form a gap therebetween. The beating section of the rotor disc is opposed to that of the stationary disc to thereby form a gap therebetween. A material is allowed to pass through the gap between the beating sections.

Also, according to a second aspect of the invention, in the refiner according to the first aspect of the invention, the beating sections of the stationary shell and the rotor disc are at least machined.

According to a third aspect of the invention, in the refiner according to the first aspect of the invention, the stationary disc is attached separately from the conical type stationary shell parallel to a longitudinal direction of the rotational shaft.

According to a fourth aspect of the invention, in the refiner according to the first aspect of the invention, the conical type rotor is attached to the rotational shaft, and rotor disc is attached separately from the conical type rotor parallel to the longitudinal direction of the rotational shaft.

According to a fifth aspect of the invention, in the refiner according to the first aspect of the invention, the conical type stationary shell is divided into at least an upstream section and a downstream section with respect to a material flow, and the conical type rotor is divided into at least an upstream section and a downstream section with respect to the material flow. Then, the upstream section of the beating section of the conical type stationary shell is opposed to the upstream section of the beating section of the conical type rotor, and the downstream section of the beating section of the conical type stationary shell is opposed to the downstream section of the beating section of the conical type rotor.

Also, a sixth aspect of the invention provides an agitating apparatus for papermaking, comprising: a conical type stationary shell including an agitating section; a stationary ring-shaped disc provided on an outer edge of the conical type stationary shell and including an agitating section; a conical type rotor attached to a rotational shaft and including an agitating section on a surface facing the conical type stationary shell; and a rotor ring-shaped disc provided on an outer edge of the conical type rotor and including an agitating section on a surface facing the conical type stationary shell. The agitating section of the conical type rotor is opposed to that of the conical type stationary shell to thereby form a gap therebetween. The agitating section of the rotor disc is opposed to that of the stationary disc to thereby form a gap therebetween. A material is allowed to pass through the gap between the agitating sections.

According to a seventh aspect of the invention, in the agitating apparatus for papermaking of the sixth aspect of the invention, the agitating sections of the stationary disc and the rotor disc are at least machined.

According to an eighth aspect of the invention, in the agitating apparatus for papermaking of the sixth aspect of the invention, the stationary disc is attached separately from the conical type stationary shell parallel to a longitudinal direction of the rotational shaft.

According to a ninth aspect of the invention, in the agitating apparatus for papermaking of the sixth aspect of the invention, the conical type rotor is attached to the rotational shaft, and the rotor disc is attached separately from the conical type rotor parallel to the longitudinal direction of the rotational shaft.

According to a tenth aspect of the invention, in the agitating apparatus for papermaking of the sixth aspect of the invention, the conical type stationary shell is divided into at least an upstream section and a downstream section with respect to a material flow, and the conical type rotor is divided into at least an upstream section and a downstream section with respect to the material flow. Then, the upstream section of the agitating section of the conical type stationary shell is opposed to the upstream section of the agitating section of the conical type rotor, and the downstream section of the agitating section of the conical type stationary shell is opposed to the downstream section of the agitating section of the conical type rotor.

DETAILED DESCRIPTION OF THE PREFERRED EMBODIMENT

Figure 1:
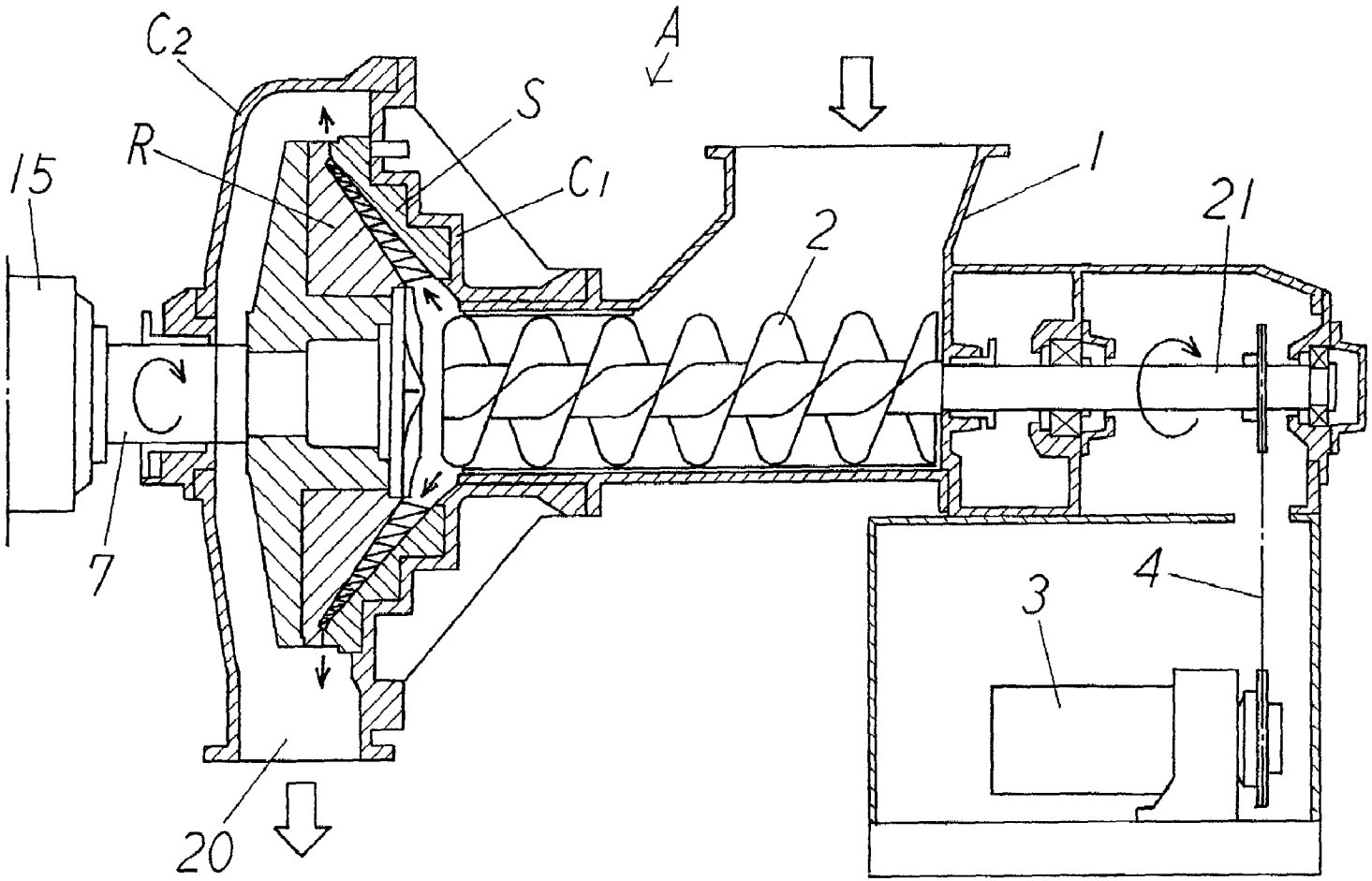
FIG. 1 is a schematic sectional view of a refiner, i.e. an agitating apparatus for papermaking, of an embodiment of the invention.
Figure 2:
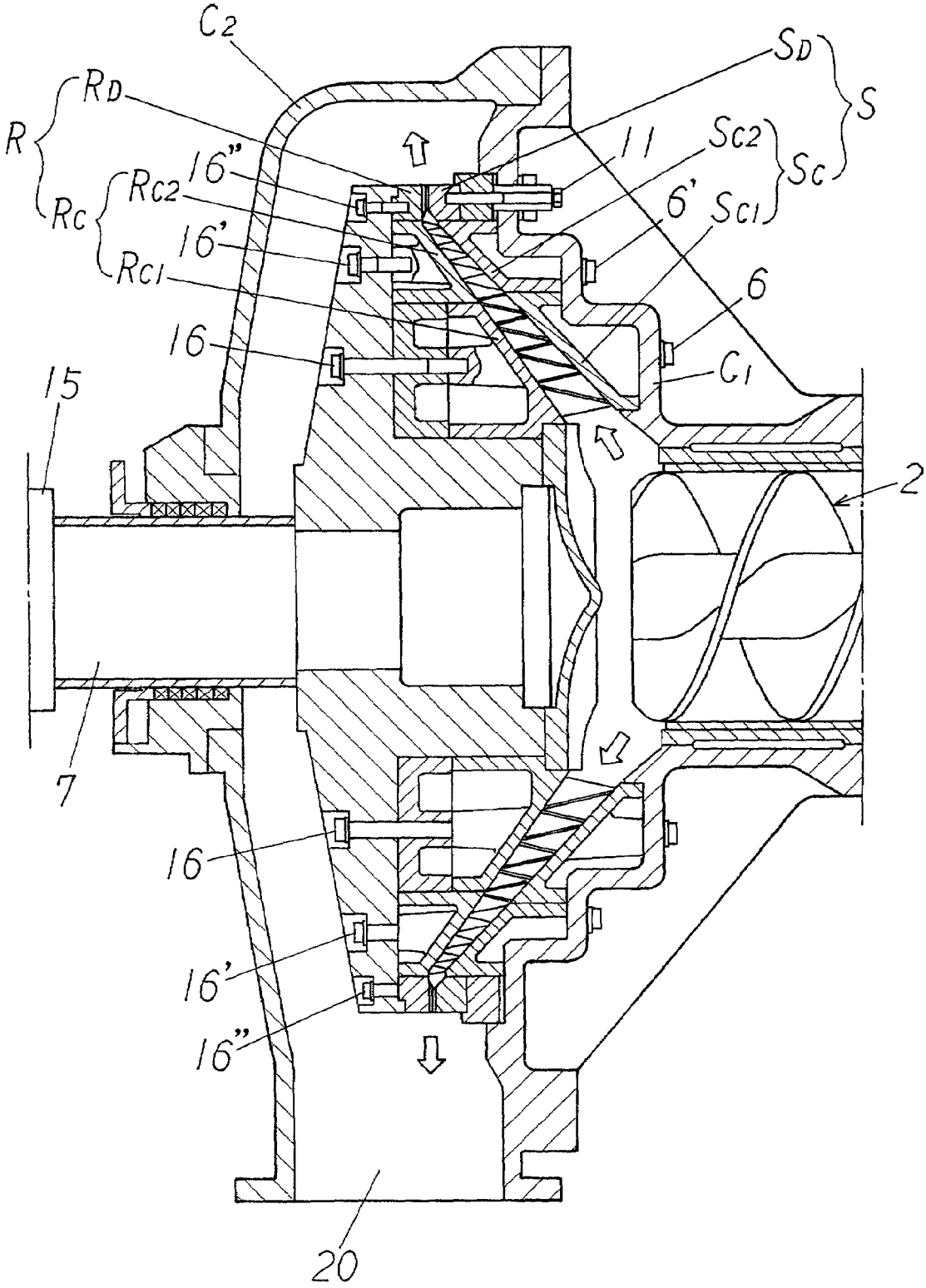
FIG. 2 is a schematic enlarged sectional view showing a beating or dissociating section shown in FIG. 1.

A refiner and an agitating apparatus for papermaking of an embodiment of the invention will be explained with reference to the accompanying drawings.

In FIG. 1 to FIG. 8, reference A denotes a refiner, and the refiner A is schematically formed of a stationary shell S and a rotor R. Reference numeral 1 denotes a material supply passage, and a screw feeder 2 is formed in the material supply passage 1. A rotational shaft 21 of the screw feeder 2 is rotated by a transmission of a rotation of a motor 3 thereto through a chain 4 (refer to FIG. 1).

Figure 3:
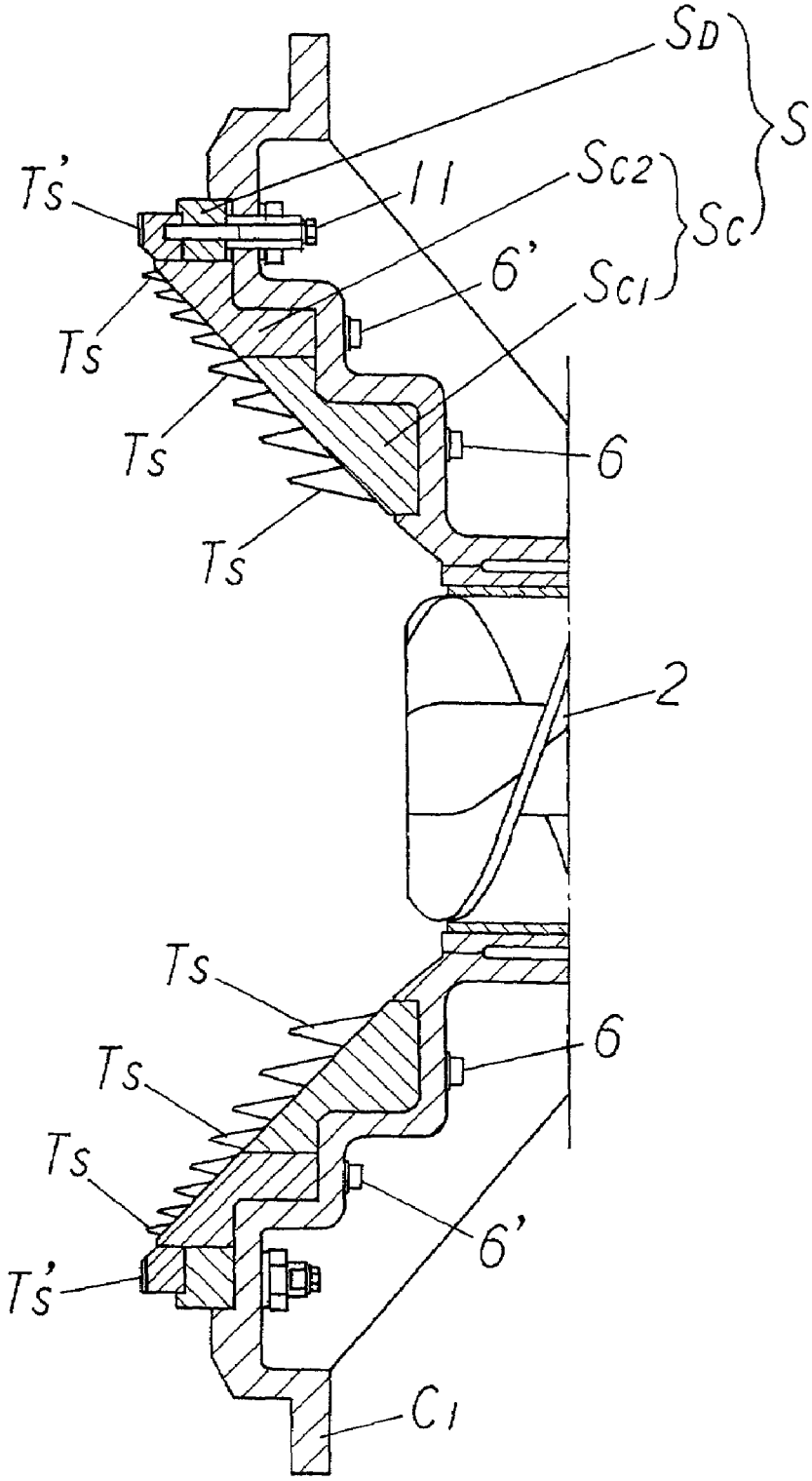
FIG. 3 is a schematic enlarged sectional view of a stationary shell at one side of the beating section in FIG. 2.
Figure 4:
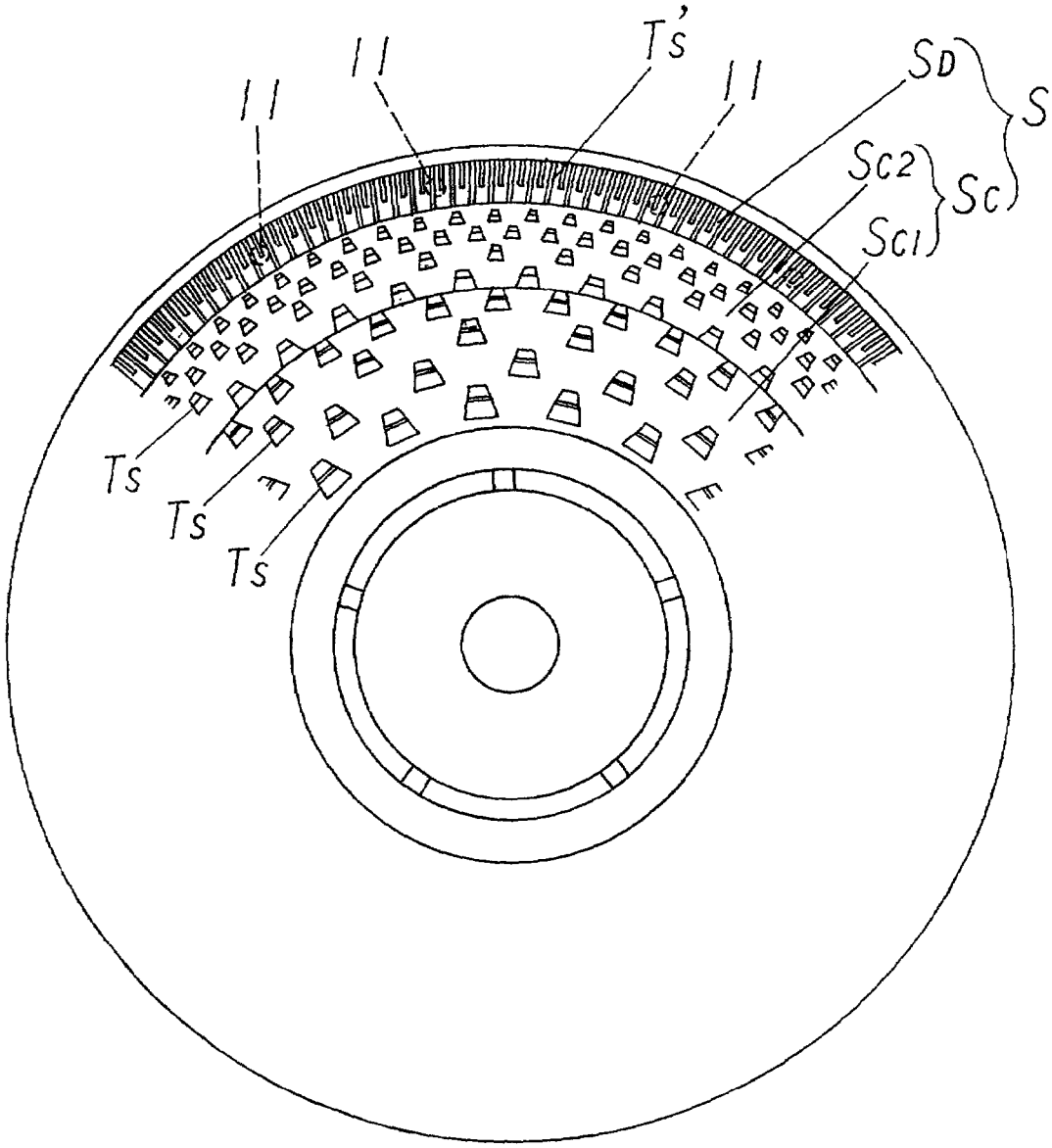
FIG. 4 is a schematic side view of the stationary shell in FIG. 3.

The stationary shell S includes a conical type stationary shell $S_C$ and a ring-shaped stationary disc $S_D$ as shown in FIG. 3 and FIG. 4. The conical type stationary shell $S_C$ is provided with a beating or dissociating section on a surface facing the rotor. The ring-shaped stationary disc $S_D$ is provided on an outer edge of the conical type stationary shell $S_C$ and includes a beating section on the surface facing the rotor. The beating section becomes an agitating section when the refiner is used as an agitating apparatus for papermaking, for example, a disperser.

The beating section of the conical type stationary shell $S_C$ is formed of projections $T_S$ as shown in FIG. 3 and FIG. 4. Incidentally, instead of the projections $T_S$ shown in FIG. 3 and FIG. 4, for example, grooves may be formed on a conical surface of the conical type stationary shell $S_C$, and the beating section may be formed of ribs formed between the adjacent grooves. A plurality of projections $T_S$ is provided, and shapes of the projections $T_S$ become smaller toward downstream of the material flow.

Also, the conical type stationary shell $S_C$ is divided into two sections, namely $S_{C1}$ and $S_{C2}$, and they are disposed at upstream and downstream of the material flow, respectively. They are attached to a first casing $C_1$ by bolts 6 and 6'. Incidentally, although the conical type stationary shell $S_C$ is divided into the upstream section $S_{C1}$ and the downstream section $S_{C2}$ in the embodiment, the present invention is not limited thereto, and the conical type stationary shell $S_C$ may be divided into three, or more. It will suffice that the conical type stationary shell $S_C$ is divided into at least the upstream section $S_{C1}$ and the downstream section $S_{C2}$.

Figure 5:
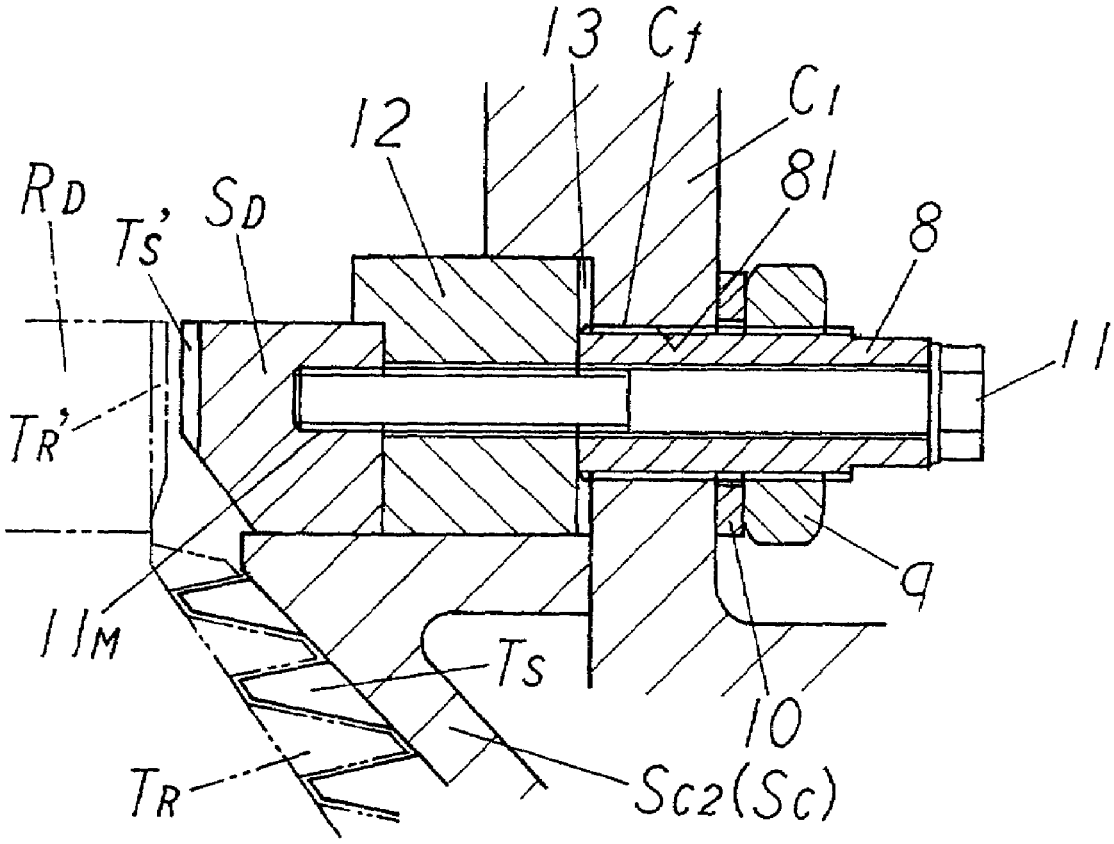
FIG. 5 is a schematic enlarged sectional view showing a part of the stationary disc in FIG. 2.
Figure 6:
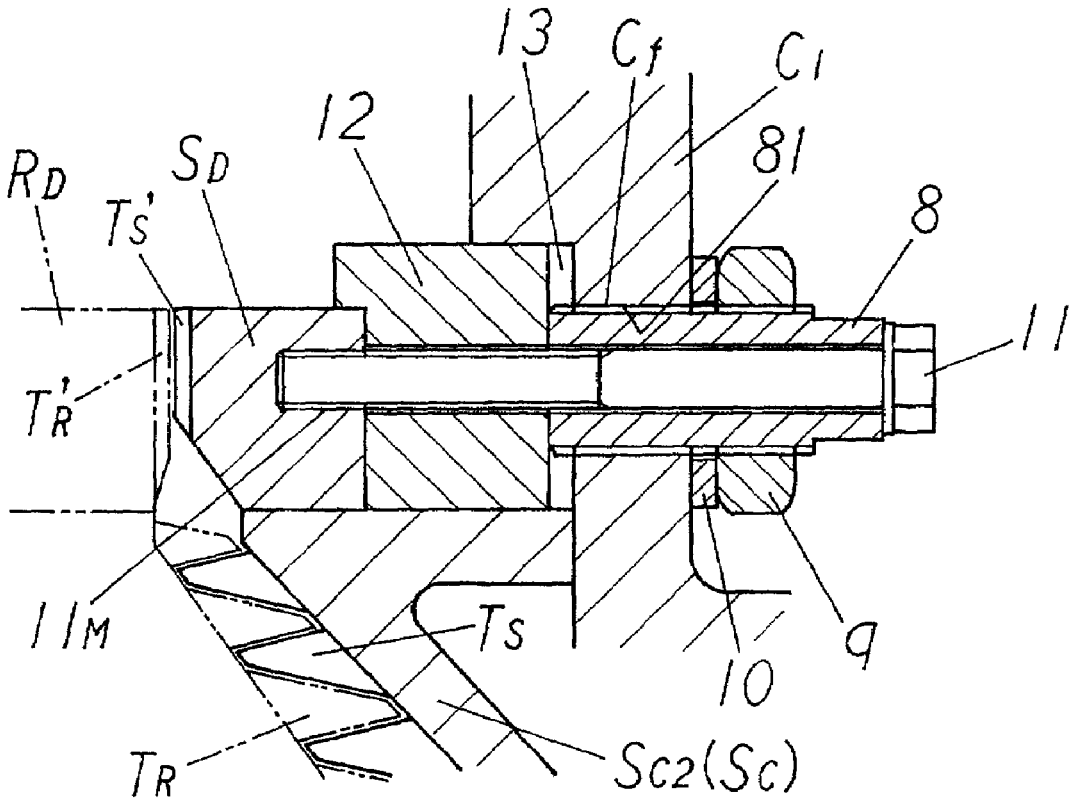
FIG. 6 is a schematic enlarged sectional view showing the condition that the stationary disc shown in FIG. 5 is moved.

Also, as shown in FIG. 1, FIG. 5 and FIG. 6, the stationary disc $S_D$ is attached to the conical type stationary shell $S_C$ to be freely moved thereto in parallel to a longitudinal direction of a rotational shaft 7 of the rotor R. This is because of the following reason. Suppose the stationary disc $S_D$ is moved with the stationary shell $S_C$. When a gap or space between a conical type rotor $R_C$ and the conical type stationary shell $S_C$ is adjusted by moving the conical type rotor $R_C$ along the rotational shaft 7, the gap or space between the stationary disc $S_D$ and a rotor disc $R_D$ is also changed, so that the gap between the stationary disc $S_D$ and the rotor disc $R_D$ can not be adjusted separately. On the contrary, if the stationary disc $S_D$ is independently attached to the conical type stationary shell $S_C$ parallel to the longitudinal direction of the rotational shaft 7, the gap between the conical type rotor $R_C$ and the conical type stationary shell $S_C$ and the gap between the stationary disc $S_D$ and the rotor disc $R_D$ can be adjusted separately.

Although the attachment of the stationary disc $S_D$ to the conical type stationary shell $S_C$ may be automatically achieved by oil pressures or the like, in the embodiment, for example, the attachment can be achieved manually as follows (refer to FIG. 5 and FIG. 6).

Reference numeral 8 denotes a cylinder body having a male screw 81 on an outer periphery thereof, and the male screw 81 respectively engages a female screw $C_f$ provided in a casing $C_1$, and a nut 9. Reference numeral 10 denotes a washer, which is located between the casing $C_1$ and the nut 9. A bolt 11 passes through a through hole of the cylinder body 8, and is projected from the cylinder body 8 shown as reference numeral $\mathbf{11}_M$.

The stationary disc $S_D$ and a disc holder 12 are attached to the male screw $\mathbf{11}_M$ projected from the cylinder body 8 by means of a female screw of the stationary disc $S_D$ and a female screw of the disc holder 12, and a gap section 13 is formed between the disc holder 12 and the casing $C_1$.

In order to further reduce the gap between the stationary disc $S_D$ and the rotor disc $R_D$ in the state shown in FIG. 5, the nut 9 and the bolt 11 are loosened, and the cylinder body 8 is rotated clockwise to move forward as shown in FIG. 6. Then, the disc holder 12 is pushed by a distal end of the cylinder body 8, to thereby move the stationary disc $S_D$ and the disc holder 12. After moving the stationary disc $S_D$ and the disc holder 12, the loosened nut 9 and the bolt 11 are tightened.

Also, in order to return to the state of FIG. 5 from the state of FIG. 6, the nut 9 and the bolt 11 are loosened, and the cylinder body 8 is rotated counterclockwise to retreat or move backward as shown in FIG. 5. Accordingly, a rear end of the cylinder body 8 pushes the bolt 11, to thereby move the stationary disc $S_D$ and the disc holder 12. After moving the stationary disc $S_D$ and the disc holder 12, the loosened nut 9 and bolt 11 are tightened. Incidentally, plural sets of the cylinder body 8, the nut 9, the washer 10 and the bolt 11 are provided annularly on the casing $C_1$. Also, as shown in FIG. 4, for example, the beating section of the stationary disc $S_D$ is formed of short and long ribs $T_S$' that define grooves and are formed between the adjacent grooves.

Figure 7:
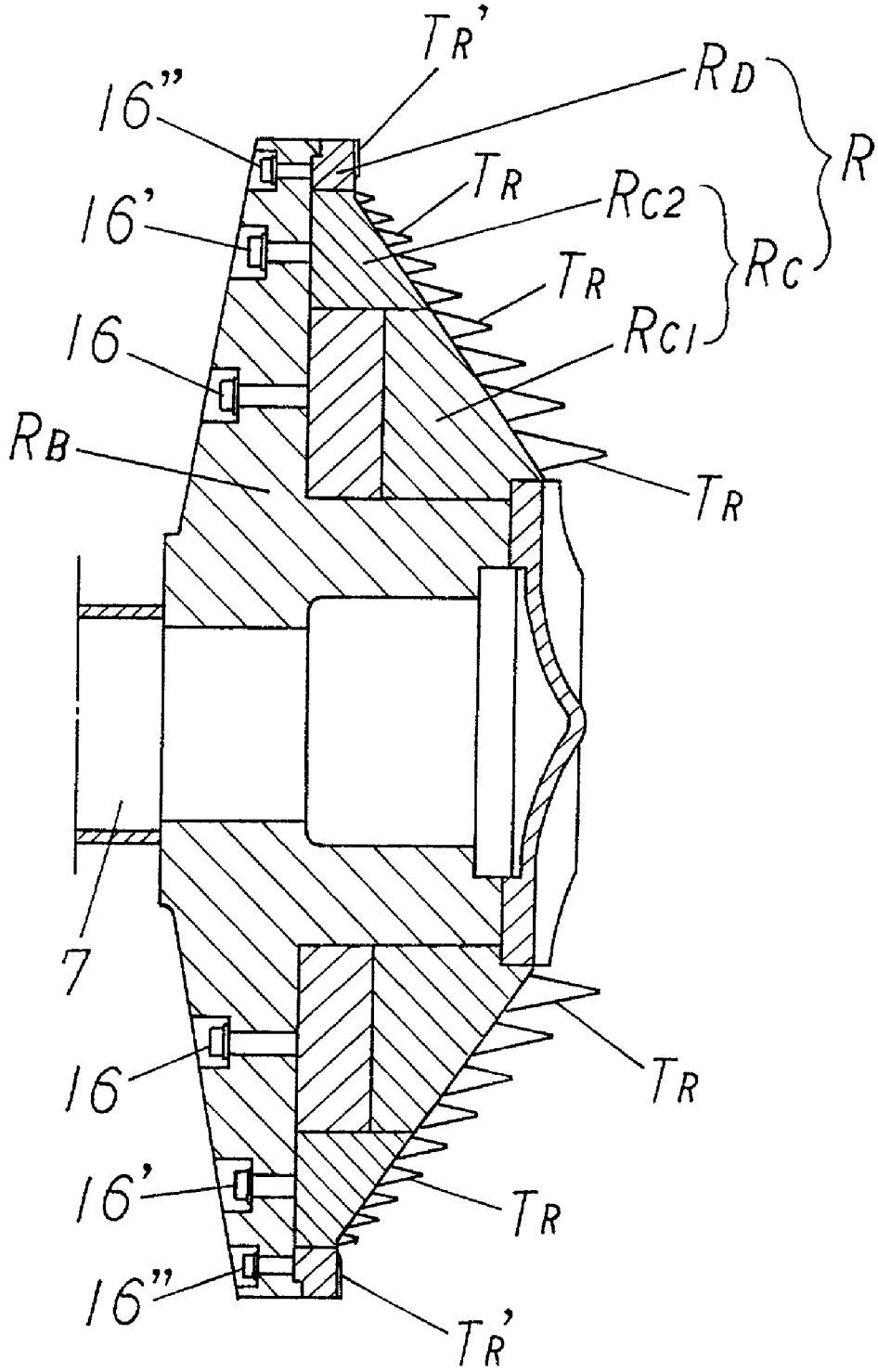
FIG. 7 is a schematic enlarged sectional view of a rotor on the other side of the beating section in FIG. 2.
Figure 8:
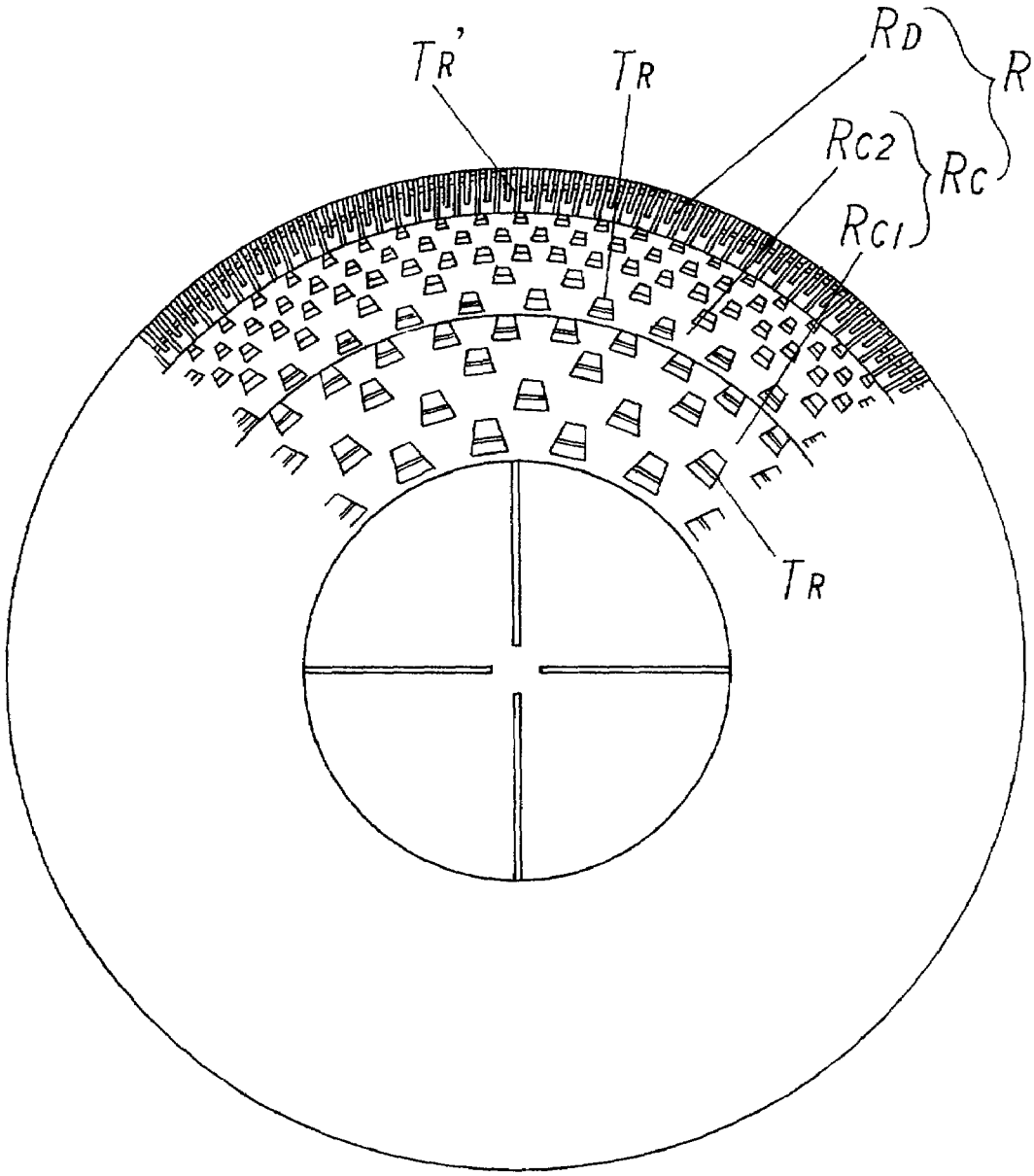
FIG. 8 is a schematic side view of the rotor in FIG. 7.

The rotor R has the conical type rotor $R_C$ and a ring-shaped rotor disc $R_D$, as shown in FIG. 7 and FIG. 8. The conical type rotor $R_C$ is provided with a beating section on a surface facing the stationary shell S. The ring-shaped rotor disc $R_D$ is provided on an outer edge of the conical type rotor $R_C$ and includes a beating section on the surface facing the stationary shell S. The beating section becomes an agitating section when the apparatus is used as an agitating apparatus like a disperser.

The beating section constitutes projections $T_R$ as shown in FIG. 7 and FIG. 8. Incidentally, instead of the projections $T_R$ as shown in FIG. 7 and FIG. 8, for example, grooves may be formed on a conical surface of the conical type rotor $R_C$, and ribs formed between the adjacent grooves may form the beating section. A plurality of projections $T_R$ is provided, and shapes of the projections $T_R$ become smaller toward downstream of the material flow.

Then, the beating section of the conical type refiner A is formed of the projections $T_S$ and the projections $T_R$ described above, and a passage formed by the gap between the projection $T_S$ and the projection $T_R$ becomes smaller toward downstream of the material flow side.

The rotor R is attached to the rotational shaft 7 rotated by the motor (not shown). Reference numeral 15 denotes a bearing case that includes a bearing for supporting the rotational shaft 7 therein (refer to FIG. 1).

The conical type rotor $R_C$ is divided into two sections, namely $R_{C1}$ and $R_{C2}$, disposed at upstream and downstream of the material flow in the beating section, respectively. They are attached to a rotor main body $R_B$ by bolts 16 and 16'. Incidentally, although the conical type rotor $R_D$ is divided into the upstream section $R_{C1}$ and the downstream section $R_{C2}$ in the present embodiment, the present invention is not limited thereto, and for example, may be divided into three or four. However, it will suffice that the conical type rotor $R_C$ is divided into at least the upstream section $R_{C1}$ and the downstream section $R_{C2}$.

Then, the upstream section $S_{C1}$ and the downstream section $S_{C2}$ of the conical type stationary shell $S_C$ are opposed to the upstream section $R_{C1}$ and the downstream section $R_{C2}$ of the conical type rotor $R_C$, respectively.

The ring-shaped rotor disc $R_D$ is disposed on the outer edge of the conical type rotor $R_C$, and attached to the rotor main body $R_B$ by a bolt 16".

Incidentally, as shown in FIG. 8, the beating section of the rotor disc $R_D$ comprises short and long ribs $T_R$' that form grooves. Also, like the stationary disc $S_D$ independently attached to the conical type stationary shell $S_C$ parallel to the longitudinal direction of the rotational shaft 7, although not shown in the drawings, the rotor disc $R_D$ may be attached to the conical type rotor $R_C$ independently to be freely moved thereto parallel to the longitudinal direction of the rotational shaft 7. A casing $C_2$ covers the rotor R. Reference numeral 20 denotes a discharge outlet.

As described above and shown in the drawings, in the refiner A, the conical type stationary shell $S_C$ is opposed to the conical type rotor $R_C$, and the stationary disc $S_D$ is opposed to the rotor disc $R_D$. The raw material passes through the gap between the conical type stationary shell $S_C$ and the conical type rotor $R_C$, and between the stationary disc $S_D$ and the rotor disc $R_D$.

Before operating the refiner 1, the gap in the beating section is adjusted. In order to adjust the gap in the beating section between the conical type stationary shell $S_C$ and the conical type rotor $R_C$, when the machine is stopped, the rotor R and the bearing case 15 slide along the rotational shaft 7 toward the stationary disc $S_D$ side until the beating section of the conical type rotor $R_C$ contacts the beating section of the conical type stationary shell $S_C$. Also, the nut 9 and the bolt 11 are loosened, and the cylinder body 8 is rotated clockwise to move forward as shown in FIG. 6 so that the distal end of the cylinder body 8 pushes the disc holder 12. When the beating section of the stationary disc $S_D$ contacts the beating section of the rotor disc $R_D$, the nut 9 and the bolt 11 are tightened. Starting from this point, the beating section of the rotor disc $R_D$ is moved backward to a predetermined appropriate position, and the rotor disc $R_D$ is fixed to the rotational shaft 7 by fixing means (bolt, oil pressures or the like), not shown.

Incidentally, after fixing, if the gap between the beating section of the stationary disc $S_D$ and the beating section of the rotor disc $R_D$ is still not appropriate, the nut 9 and the bolt 11 are loosened, and the cylinder body 8 is rotated clockwise or counterclockwise to adjust the position thereof so that an appropriate gap is obtained. After adjusting the gap, the loosened nut 9 and the bolt 11 are tightened.

After adjusting the gap in the beating section, when the refiner 1 is operated, the raw material is supplied to the beating section through the material supply passage 1 and the screw feeder 2. While the raw material is passing through the gap between the rotor R and the stationary shell or stator S, the separation and beating of the material are carried out, to thereby be led to the next step through the discharge outlet 20.

Incidentally, upon beating the raw material, since the beating section of the stationary disc $S_D$ and the beating section of the rotor disc $R_D$ are provided, the gap in the beating section between them can be narrowed. Accordingly, it is difficult for the material to pass therethrough, resulting in resistance against the material flow, so the raw material can be charged in a higher degree. Namely, the material can be retained for longer period of time in the gap between the conical type stationary shell $S_C$ and the conical type rotor $R_C$.

Incidentally, it is desirable that at least the beating sections of the stationary disc $S_D$ and the rotor disc $R_D$ are machined because of the following reason.

Since "the conical type stationary shell $S_C$ with the beating section" and "the conical type rotor $R_C$ with the beating section" are generally formed of cast steel, and the shapes thereof are conical, it is difficult to machine the beating sections thereof to improve dimensional accuracy thereof. However, the gap between the stationary disc $S_D$ and the rotor disc $R_D$ can be adjusted with high accuracy, and the gap becomes the resistance in the raw material flow. Accordingly, the raw material can be held for longer period of time in the gap between the conical type stationary shell $S_C$ and the conical type rotor $R_C$, and fibers in the raw material are further crumpled with each other and dissociated.

Incidentally, it is obvious that the refiner A in the embodiment described above can grind a chip, or beat and crumble a pulp, and moreover, the refiner A can be used as an agitating apparatus for papermaking (for example, a disperser), which agitates a wastepaper material in order to facilitate an separation of adhesives, such as ink and hot-melt, from the fiber in the wastepaper material. In this case, the raw material is a wastepaper pulp.

When wastepaper pulp with a high concentration is dispersed in the disperser, the beating section described above works as an agitating section, and the fibers in the wastepaper pulp are strongly worn out in the agitating section. Accordingly, ink stuck to the fibers can be peeled off, fractionated or comminuted, and dispersed, and the adhesive is peeled off, fractionated, and dispersed, to thereby facilitate a process to eliminate ink in the subsequent steps.

Incidentally, since the refiner has the same structure as that of the agitating apparatus for papermaking except that the beating section of the refiner A described above forms the agitating section of the agitating apparatus for papermaking, the explanation for the agitating apparatus for papermaking is omitted herewith.

According to the refiner of the first aspect of the invention, by providing the beating sections of the stationary disc and the rotor disc, a resistance in the raw material flow is created, and the raw material is held in the gap in the beating sections for longer period of time, so that the fibers in the raw material can be further crumpled with each other and dissociated.

Also, since "the conical type stationary shell with the beating section" and "the conical type rotor with the beating section" are formed of cast steel, and the shapes thereof are conical, it is difficult to machine the beating sections to improve the dimensional accuracy thereof. However, according to the refiner of a second aspect of the invention, in addition to the effect of the invention according to the first aspect, the gap between the machined beating sections of the stationary disc and the rotor disc can be adjusted with higher accuracy, so that the gap becomes resistance in the material flow more efficiently. Accordingly, the material can be held for a longer period of time in the gap between the beating sections of the conical type stationary shell and the conical type rotor, and the fibers in the material can be further crumpled with each other and dissociated.

If the stationary disc can not be moved separately from the conical type stationary shell, when the conical type rotor is moved along the rotational shaft to adjust the gap between the conical type rotor and the conical type stationary shell, the gap between the stationary disc and the rotor disc is determined accordingly, thus, the gap between the stationary disc and the rotor disc can not be adjusted independently. However, according to the refiner of a third aspect of the invention, in addition to the effect of the first aspect of the invention, since the stationary disc is independently attached to the conical type stationary shell parallel to the longitudinal direction of the rotational shaft, the gap between the conical type rotor and the conical type stationary shell and between the stationary disc and the rotor disc can be individually adjusted.

If the rotor disc can not be moved separately from the conical type rotor, when the conical type rotor is moved along the rotational shaft to adjust the gap between the conical type rotor and the conical type stationary shell, the gap between the stationary disc and the rotor disc is determined accordingly, so that the gap between the stationary disc and the rotor disc can not be adjusted independently. However, according to the refiner of a fourth aspect of the invention, in addition to the effect of the first aspect of the invention, since the rotor disc is independently attached to the conical type rotor parallel to the longitudinal direction of the rotational shaft, the gap between the conical type rotor and the conical type stationary shell and between the stationary disc and the rotor disc can be individually adjusted.

According to the refiner of the fifth aspect of the invention, in addition to the effect of the first aspect of the invention, the extent of damages in the beating sections can be different in the upstream section and the downstream section of the material flow with time. Also, depending on a site damaged by foreign substances, it may not be necessary to replace the entire beating section. In that case, since the conical type stationary shell and the conical type rotor are respectively divided into at least the upstream section and the downstream section of the material flow, only the damaged section needs to be replaced without replacing the entire beating section. Since the conical type stationary shell and the conical type rotor are divided, it is easy to manufacture them. Incidentally, the beating section of the conical type stationary shell and the beating section of the conical type rotor are difficult to manufacture, normally, due to their large sizes.

According to the agitating apparatus for papermaking of the sixth aspect of the invention, since the agitating section of the stationary disc and the agitating section of the rotor disc are provided, they cause resistance in the raw material flow. Thus, the raw material can be held for a longer period of time in the gap between the agitating sections of the conical type stationary shell and the conical type rotor, so the fibers in the material can be further crumpled and agitated.

Also, since "the conical type stationary shell with the agitating section" and "the conical type rotor with the agitating section" are formed of cast steel, and the shapes thereof are conical, it is difficult to machine the agitating sections to improve the dimensional accuracy thereof. However, according to the agitating apparatus for papermaking of the seventh aspect of the invention, in addition to the effect of the sixth aspect of the invention, the gap between the agitating sections of, the stationary disc and the rotor disc can be adjusted with higher accuracy, and the gap becomes resistance in the raw material flow more effectively. Accordingly, the raw material can be held for a longer period of time in the gap between the agitating sections of the conical type stationary shell and the conical type rotor, and the fibers in the raw material can be further crumpled with each other and agitated.

If the stationary disc can not be moved separately from the conical type stationary shell, when the conical type rotor is moved along the rotational shaft to adjust the gap between the conical type rotor and the conical type stationary shell, the gap between the stationary disc and the rotor disc is determined accordingly, so the gap between the stationary disc and the rotor disc can not be adjusted independently. However, according to the agitating apparatus for papermaking of the eighth aspect of the invention, in addition to the effect of the sixth aspect of the invention, since the stationary disc is independently attached to the conical type stationary shell parallel to the longitudinal direction of the rotational shaft, the gap between the conical type rotor and the conical type stationary shell, and between the stationary disc and the rotor disc can be individually adjusted, respectively.

If the rotor disc can not be moved separately from the conical type rotor, when the conical type rotor is moved along the rotational shaft to adjust the gap between the conical type rotor and the conical type stationary shell, the gap between the stationary disc and the rotor disc is determined accordingly, so the gap between the stationary disc and the rotor disc can not be adjusted independently. However, according to the agitating apparatus for papermaking of the ninth aspect of the invention, in addition to the effect of the sixth aspect of the invention, since the rotor disc is independently attached to the conical type rotor parallel to the longitudinal direction of the rotational shaft, the gap between the conical type rotor and the conical type stationary shell, and between the stationary disc and the rotor disc can be individually adjusted.

According to the agitating apparatus of the tenth aspect of the invention, in addition to the effect of the sixth aspect of the invention, the extent of damages in the beating sections may be different in the upstream section and the downstream section of the material flow with time. Also, depending on a site damaged by foreign substances, it may not be necessary to replace the entire beating section. In that case, since the conical type stationary shell and the conical type rotor are respectively divided into at least the upstream section and the downstream section of the material flow, only the damaged section needs to be replaced without replacing the entire beating section. Since the conical type stationary shell and the conical type rotor are divided, it is easy to manufacture them. Incidentally, the beating section of the conical type stationary shell and the beating section of the conical type rotor are difficult to manufacture, normally, due to their large sizes.

While the invention has been explained with reference to the specific embodiments of the invention, the explanation is illustrative and the invention is limited only by the appended claims.

What is claimed is:

1. An apparatus for separating and beating a material, comprising:

a conical stationary shell having a first beating section, a ring-shaped stationary disc provided outside the conical stationary shell and having a second beating section, means for fixing the stationary disc to the stationary shell and moving the stationary disc independently relative to the stationary shell parallel to a central axis thereof, said fixing means having a body extending from the stationary disc to change a position of the stationary disc relative to the stationary shell, a conical rotor including a third beating section facing said first beating section to create a gap between the first beating section and the third beating section for the material to pass therethrough, a ring-shaped rotor disc provided outside the conical rotor and including a fourth beating section facing said second beating section to create a gap between the second beating section and the fourth beating section for the material to pass therethrough, and a rotational shaft attached to the conical rotor for supporting and rotating the same.

2. An apparatus according to claim 1, wherein the second beating section of the ring-shaped stationary disc and the fourth beating section of the ring-shaped rotor disc are machined discs.

3. An apparatus according to claim 1, wherein the ring-shaped rotor disc is connected to and moved independently relative to the conical rotor parallel to a longitudinal direction of the rotational shaft.

4. An apparatus according to claim 1, wherein the conical type stationary shell is divided into at least an upstream section and a downstream section with respect to a material flow, and the conical rotor is divided into at least an upstream section and a downstream section with respect to the material flow.

5. An apparatus according to claim 1, wherein said first and third beating sections face each other so that a distance between the first and third beating sections is gradually decreased along a flow direction of the material.

6. An apparatus according to claim 5, wherein said gap between the second and fourth beating sections is narrower than the distance between the first and third beating sections.

7. An apparatus according to claim 1, further comprising a casing with a female screw, to which the stationary shell and the stationary disc are attached, said body being a cylinder body having a male screw engaging the female screw of the casing.

8. An apparatus according to claim 7, wherein said fixing means further includes a nut engaging the cylinder body to fix the cylinder body to the casing, and a bolt passing through the cylinder body and engaging the stationary disc to fix the stationary disc to the cylinder body.

* * * * *